US012195935B2

(12) United States Patent
Giletta

(10) Patent No.: US 12,195,935 B2
(45) Date of Patent: Jan. 14, 2025

(54) METHOD AND SNOWPLOW BLADE FOR REMOVING SNOW FROM A ROAD SURFACE

(71) Applicant: GILETTA S.P.A., Revello (IT)

(72) Inventor: Enzo Giletta, Revello (IT)

(73) Assignee: GILETTA S.P.A. (IT)

( * ) Notice: Subject to any disclaimer, the term of this patent is extended or adjusted under 35 U.S.C. 154(b) by 559 days.

(21) Appl. No.: 17/577,254

(22) Filed: Jan. 17, 2022

(65) Prior Publication Data

US 2022/0228336 A1 Jul. 21, 2022

(30) Foreign Application Priority Data

Jan. 19, 2021 (IT) ..... 102021000000857

(51) Int. Cl.
*E01H 10/00* (2006.01)
*E01H 5/06* (2006.01)

(52) U.S. Cl.
CPC ..... *E01H 10/007* (2013.01); *E01H 5/061* (2013.01); *E01H 5/066* (2013.01)

(58) Field of Classification Search
CPC ..... A01B 35/08; E01H 5/00; E01H 5/061; E01H 5/066; E01H 10/007
See application file for complete search history.

(56) References Cited

U.S. PATENT DOCUMENTS

| | | | | |
|---|---|---|---|---|
| 3,400,475 | A | 9/1968 | Peitl | |
| 5,515,623 | A * | 5/1996 | Weeks | E01H 10/007 239/289 |
| 7,137,214 | B2 | 11/2006 | Hoerly et al. | |
| 8,403,595 | B2 * | 3/2013 | Hall | E01C 23/088 299/39.1 |
| 9,976,268 | B2 * | 5/2018 | Giletta | E01H 5/00 |
| 2005/0204587 | A1 | 9/2005 | Kime | |
| 2019/0376247 | A1 | 12/2019 | Giletta | |

FOREIGN PATENT DOCUMENTS

AT 413563 B 3/2006

* cited by examiner

*Primary Examiner* — Thomas B Will
*Assistant Examiner* — Robert E Pezzuto
(74) *Attorney, Agent, or Firm* — The Belles Group, P.C.

(57) ABSTRACT

A snowplow blade has a rolling body, a snow removal cutting edge connected to a lower portion of the rolling body, a motorized assembly for attaching the rolling body to a means for moving the snowplow blade forward; a plurality of nozzles delivering a de-icing liquid for the residual snow left on the road surface by the cutting edge; and a circuit for feeding and controlling the de-icing liquid sent to the nozzles; the feeding and control circuit having a mechanically operated monostable valve and a feeler, which is designed to cooperate, in use, with the road surface or with a mobile member of the motorized attachment assembly in order to close the monostable valve when the height of the cutting edge from the road surface exceeds a predefined threshold value.

11 Claims, 4 Drawing Sheets

METHOD AND SNOWPLOW BLADE FOR REMOVING SNOW FROM A ROAD SURFACE

CROSS-REFERENCE TO RELATED APPLICATIONS

This patent application claims priority from Italian Patent Application No. 102021000000857 filed on Jan. 19, 2021, the entire disclosure of which is incorporated herein by reference in its entirety.

TECHNICAL FIELD

The invention relates to a method and to a snowplow blade for removing snow from a road surface.

BACKGROUND ART

In order to remove snow from a road surface, snowplow blades are used, which have a snow removal cutting edge.

Following the passage of the blade and regardless of the position of the removal cutting edge, a compact layer of pressed residual snow remains on the road surface, which makes the road surface slippery both for vehicles and for pedestrians driving or walking on the road surface after the snow removal.

The problem of the presence the compact layer is solved by associating the removal cutting edge with a plurality of nozzles delivering a so-called de-icing liquid, as described in patent applications no 2526230A1 and no 19176821.7 owned by the Applicant of this patent application.

The liquid delivered by the nozzles wets the residual snow layer and gets mixed and compressed either by the snow removal cutting edge or by an additional pressing and mixing cutting edge, thus forming a mixture of residual snow and de-icing liquid, in which the de-icing liquid is evenly dispersed in the residual snow, hence causing the melting of the residual snow and avoiding a following icing thereof.

The de-icing liquid has a relatively high cost and, if it is present in large quantities, can damage or pollute soils and/or attack structures arranged around the road surface. For this reason, it is important, and increasingly necessary, to properly measure the quantity of liquid and limit it to the sole amount needed to melt the residual snow, but it is also important to activate the delivery of said liquid only when strictly needed, namely at the beginning of the snow removal process, and to interrupt said delivery at the end of the snow removal process and, in general, every time the cutting edge, for different reasons, is lifted relative to a predefined snow removal position.

The control of the delivery is currently carried out by the operator of the machine in a manual manner or by means of solenoid valves controlled by an electronic control unit.

Experiments have shown that, in both cases, the control of the delivery proves to be unsatisfying. In the first case, because of a lack of attention or of tiredness on the part of the operator who operates the machine for many hours and, in the second case, because of the fact that the low temperature and critical environmental conditions in which the blade has to operate jeopardize the functionality thereof, in some cases, and, in other cases, the efficiency of the electronic command and control devices available.

In addition, said electronic command and control devices, which can include pressure switches or transducers, are relatively expensive and extremely sensitive to the presence of de-icing liquids, which normally consist of saline solutions and, hence, are relatively aggressive.

DISCLOSURE OF INVENTION

The object of the invention is to provide a snowplow blade, which can solve the problems discussed above in a simple and low-cost fashion, in particular a blade provided with a system for controlling the supply of snow de-icing liquid in an efficient and reliable manner.

A further object of the invention is to provide a snowplow blade, in which the de-icing liquid supply system does not require any operation or control on the part of the operator carrying out the snow removal process and which operates independently of the environmental conditions in which the snowplow blade is set.

According to the invention, there is provided a snowplow blade for removing snow from a snow-covered road surface; the blade comprising: a rolling body; a motorized assembly for moving and attaching the rolling body to means for moving the snowplow blade forward; a snow removal cutting edge connected to a lower portion of said rolling body and designed to slide, in use, adjacent to the road surface leaving a layer of residual snow on the road surface; a feeding assembly for feeding a de-icing material for the residual snow, the feeding assembly comprising delivery means for said de-icing material and a circuit for feeding the de-icing material to said delivery means; the feeding circuit comprising shut-off valve means for said de-icing material and control means for said valve means, wherein the valve means comprise a mechanically operated monostable valve and in that said control means are mechanical means and comprise a feeler configured to cooperate, in use, with the road surface or with a mobile member of said attachment assembly and to close the monostable valve when the height of the cutting edge from the road surface exceeds a predefined threshold value.

Preferably, in the blade defined above, the monostable valve comprises a mobile switching member and the feeler is fixed or hinged to said mobile switching member.

Furthermore, the feeler is preferably arranged adjacent to said removal cutting edge and, conveniently, downstream of the cutting edge in the forward direction of the blade.

A further object of the invention is to provide a method for removing snow from a snow-covered road surface.

According to the invention, there is provided a method for removing snow from a snow-covered road surface as claimed in claim 7.

BRIEF DESCRIPTION OF THE DRAWINGS

The invention will now be described with reference to the accompanying drawings, which show a non-limiting embodiment thereof, wherein.

DETAILED DESCRIPTION

Figure 1:
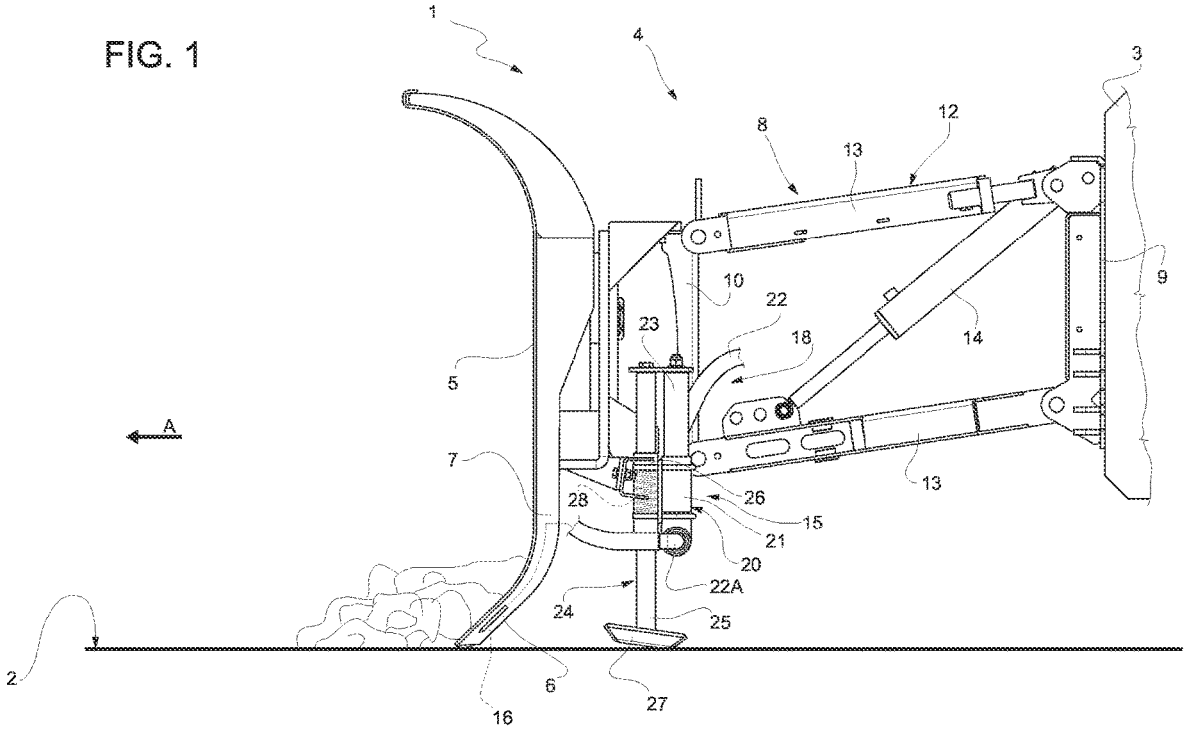
FIG. 1 shows, in side elevation, a snowplow vehicle provided with a snowplow blade according to the invention.

In the accompanying figures, number 1 indicates, as a whole, a motorized snowplow vehicle, which is partially shown and is designed to remove snow from a snow-covered road surface 2.

The snowplow vehicle 1 comprises a tractor 3, which is partially shown, and a snowplow blade 4 moved by the tractor 3 in a direction A. The blade 4 comprises a known rolling body 5 and a snow removal cutting edge 6, which is firmly connected to a lower portion 7 of the rolling body 5 and projects downward in order to remove at least part of the snow present on the road surface 2.

Preferably, both the rolling body 5 and the cutting edge 6 are made of a metal material or of a polymer material.

The blade 4 further comprises a motorized assembly 8 for attaching the rolling body 5 to the tractor 3 and for moving the rolling body 5 relative to the tractor 3.

The assembly 8 comprises an attachment plate 9 fixed to the tractor 3, a mobile plate 10 coupled, in a known manner, to the rolling body 5 and an articulated arm 12 comprising a plurality of arms 13 hinged to the fixed plate 9, on one side, and to the mobile plate 10, on the other side.

Figure 2:
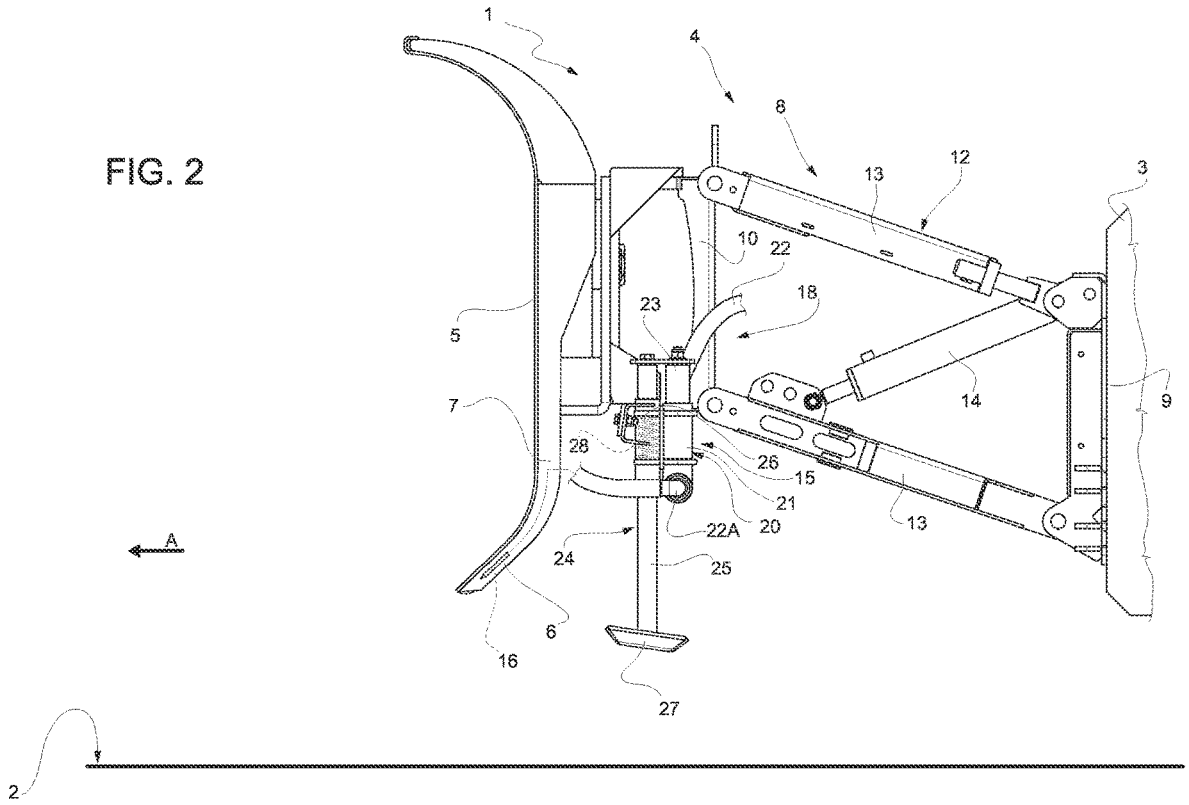
FIG. 2 is similar to FIG. 1 and shows the snowplow blade of FIG. 1 in a different functional condition.

The assembly 8 further comprises a hydraulic actuator 14, which is controlled by an operator in order to vertically move the rolling body 5 and the cutting edge 7 from and to the road surface 2 between a lowered snow removing operating position, which is shown in FIG. 1, and a lifted waiting position, which is shown in FIG. 2.

With reference to FIGS. 1 and 2, again, the blade 4 further comprises a feeding assembly 15 for feeding a de-icing material onto the residual snow remaining on the road surface 2 following the passage of the cutting edge 6.

The de-icing material can be a granular material or, conveniently, a liquid solution or a liquid, like in the example described herein.

The assembly 15 comprises one single delivery channel or one or more delivery nozzles 16, which are known and not described in detail, only one of them being schematically shown in the accompanying figures. In the example described herein, the delivery nozzles 16 are arranged inside the cutting edge 6. Alternatively, the delivery nozzles 16 are arranged on the outside of or adjacent to the cutting edge 6.

Regardless of the position of the delivery nozzles 16, the assembly 15 comprises a (schematically shown) circuit 18 for feeding and controlling the de-icing liquid flow delivered by the delivery nozzles 16 as a function of the position or height of the blade 4 relative to the road surface 2.

The circuit 18 comprises a monostable shut-off valve 20, namely of the on-off type, which is mechanically operated.

With reference to FIGS. 1 and 2, the valve 20 comprises a valve body 21, which is arranged in a position adjacent to the cutting edge 6 and is preferably, though not necessarily, fixed to the mobile plate 10 behind the rolling body 5 and the cutting edge 6.

Conveniently, the position of the valve 20 is chosen so as to be as close as possible to the nozzles 16, so as to minimize the quantity of de-icing liquid present between the nozzles 16 and the valve 20.

The valve 20 has an inlet connected to a de-icing material feeding pipe 22 and an outlet 22A connected to the nozzles 16 in a direct manner or by means of one or more manifolds (which are not shown herein).

The valve 20 further comprises a mobile switching member 23, which is mechanically connected to a mechanical control device 24 arranged downstream of the cutting edge 6 in the forward direction of the blade 4. Hereinafter, "mechanical control device" indicates a completely mechanical device without electric position detecting or commanding and controlling parts.

In the example described herein, the device 24 comprises a stem 25, which is guided in a sliding manner an in opposite directions by a straight guide 26 integral to the fixed plate 10, and a feeler 27, conveniently of the type having a slide, which is fixed or hinged to the lower end of the stem 25.

Preferably, the stem 25 and the feeler 27 are pushed towards the road surface 2 and are arranged in an extracted limit stop position of theirs by an elastic body, conveniently a schematically shown helical spring 28, as visible in FIG. 2.

Alternatively, the stem 25 and the feeler 27 move towards their extracted position only due to their weight when the cutting edge is lifted.

In any case, when it is arranged in its extracted position, the stem 25 holds the valve 20 in a closing position of its, in which it prevents the de-icing liquid from flowing towards the nozzles 16.

The position and the length of the stem 25 can be chosen in such a way that, when the cutting edge 6 is arranged in its lowered snow removing position, the feeler 27 cooperates, in a sliding manner, with the road surface 2 or with the residual snow mixed with the de-icing liquid and moves the stem 25 to a retracted position of its, in which it holds the valve 20 in an opening position of its, allowing the de-icing liquid to flow towards the nozzles 16, as visible in FIG. 1.

The operation of the blade 4 will now be described starting from the condition, shown in FIG. 2, in which the rolling body 5 and the cutting edge 6 are arranged in their lifted position and in which the feeler 27 is spaced apart from the road surface 2 and is arranged, due to the spring 28 or to its own weight, in its extracted position, which corresponds to a closing condition of the valve 20.

In this condition, the delivery of the de-icing liquid towards the nozzles 16 is inhibited. Starting from this condition and before moving the blade 4 in the direction A, the operator of the machine lowers the rolling body 5 and the cutting edge 6 towards their lowered snow removing position. Owing to the above, during this lowering, the feeler 27 meets the road surface 2 slightly in advance relative to the instant in which the cutting edge 6 reaches its lowered snow removing position and, due to the thrust of the rolling body 5 moving downward, the stem 25 draws back overcoming the action of the spring 28, when present, and switching the valve 20 to an open state so as to start the delivery of the de-icing liquid.

When, for whatever reason, the rolling body 5 and the cutting edge 6 lift, hence moving away from the road surface 2 by a predetermined amount, which exceeds the maximum stroke of the feeler 27, the feeler 27 loses contact with the road surface 2 and the valve 20 is switched to its closing position and the delivery of the de-icing liquid is interrupted.

Owing to the above, it is evident that the feeding assembly 15 described herein limits the quantity of de-icing liquid to the essential, since it continuously detects the position or the height of the cutting blade 6 relative to the road surface 2 and interrupts the delivery when the distance of the cutting edge 6 from the road surface 2 exceeds a predetermined threshold value, beyond which delivering the de-icing liquid is useless. In other words, the feeding assembly 15 operates in a continuous manner and as a function of the height position of the cutting edge 6.

Therefore, the feeding assembly 15 evidently controls the delivery of the de-icing material in a completely autonomous manner, with no intervention of the operator of the machine and with no need for any electronic control.

The use of a common ON/OFF valve and the mechanical control of said valve by means of a simple feeler make the feeding assembly 15 easy to be manufactured, not expensive and extremely efficient and reliable, regardless of the environmental or climatic conditions in which the machine operates.

Figure 3:
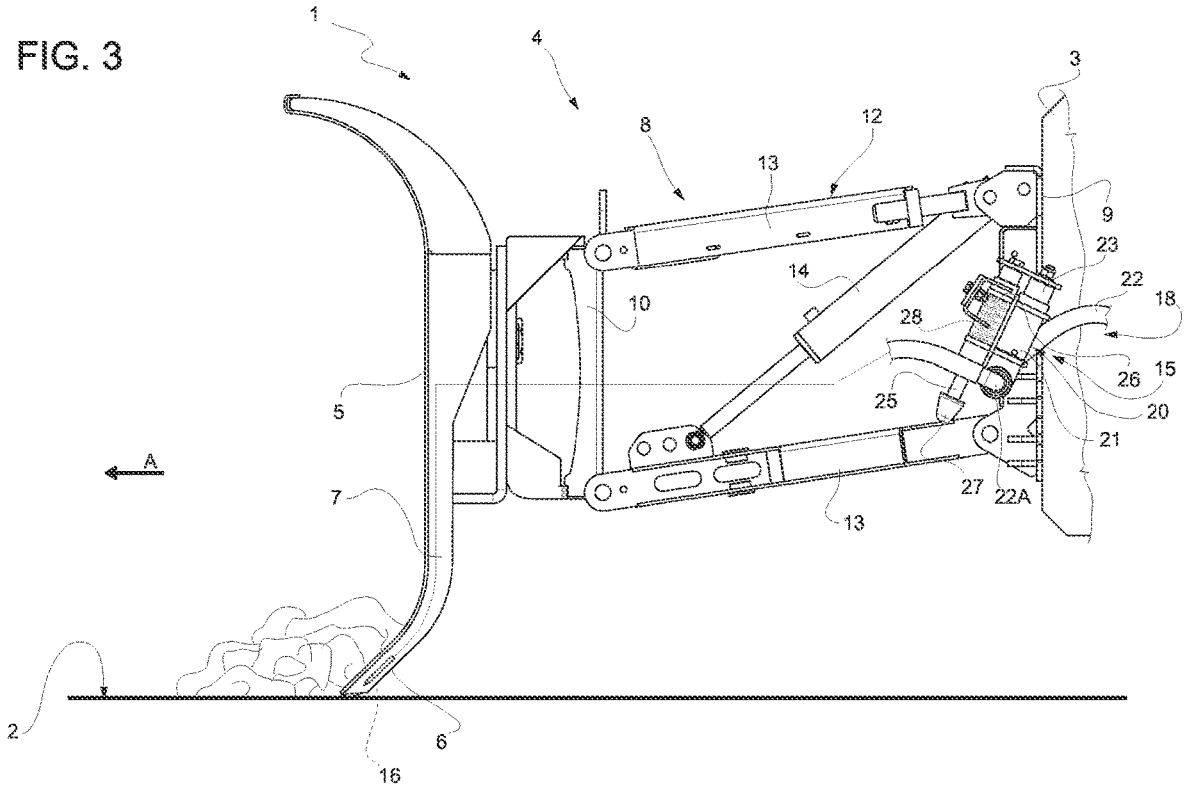
FIGS. 3 and 4 are similar to FIG. 1 and to FIG. 2, respectively, and show a variant of a detail of FIGS. 1 and 2.
Figure 4:
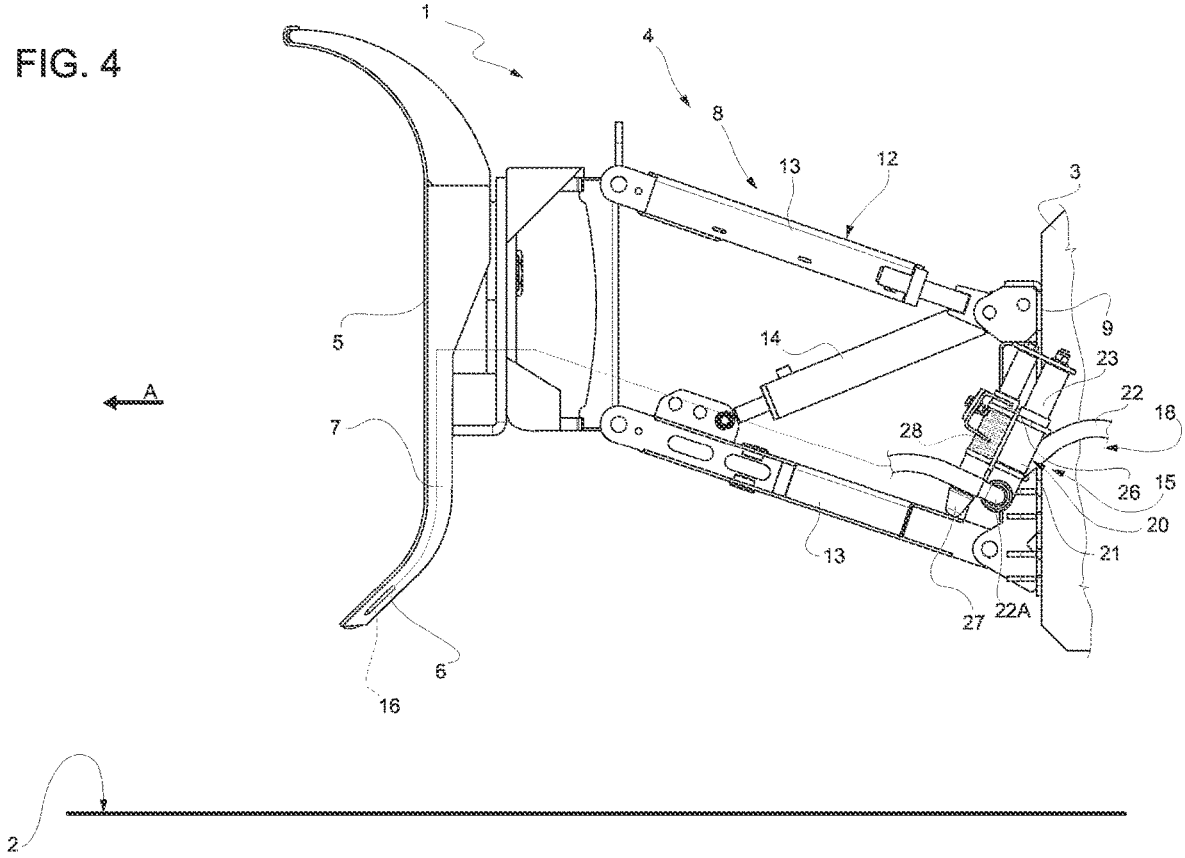

In the variant shown in FIGS. 3 and 4, the valve body 21 and the guide 26 are fixed to the fixed plate 9 and the feeler 27 is arranged so as to strike against one of the arms 13. Contrary to the solution described above, in this variant the valve 20 is configured to be closed when the stem 25 is arranged in the retracted position and to be open when the stem 25 is pushed by the spring 26 to its extracted position. In this variant as well, the stroke of the feeler 27 is such that it switches the valve 20 an opening state immediately before the cutting edge 6 reaches its lowered snow removing position and to a closing state when the cutting edge 6 is arranged at a height from the road surface that is greater than the expected removal height. In this variant as well, therefore, the feeler 27 detects, always in a continuous manner, the height position of the cutting edge 6 and the stem 25 causes the valve 20 to close when the arm 13 rotates in a clockwise direction in FIGS. 3 and 4.

Owing to the above, it is evident that blade 4 described herein can be subjected to changes and variants, without for this reason going beyond the scope of protection set forth in the claims.

In particular, the valve 20 could be arranged in a position other than the one indicated above and the feeler 27 could be manufactured in a different manner from the one described herein by way of example and be coupled to the mobile switching member 23 of the valve 20 in a different manner, for example by means of hinges, levers or other transmission or deflection elements.

Finally, the feeler could cooperate with other mobile elements of the blade 4 or with other mobile elements of the motorized attachment assembly 8, which, in turn, could be different from the one indicated herein by way of example. For example, the feeler 27 could cooperate with mobile members carried or moved by the hydraulic actuator 14 or the feeler 27 could cooperate with the output rod of the hydraulic actuator 14.

The invention claimed is:

1. A snowplow blade for removing snow from a snow-covered road surface; the blade comprising:

a rolling body;

a motorized assembly for moving and attaching the rolling body to means for moving the snowplow blade forward;

a snow removal cutting edge connected to a lower portion of said rolling body and designed to slide, in use, adjacent to the road surface leaving a layer of residual snow on the road surface;

a feeding assembly for feeding a de-icing material for the residual snow, the feeding assembly comprising a delivery means for said de-icing material and a circuit for feeding the de-icing material to said delivery means;

the feeding circuit comprising a shut-off valve means for said de-icing material and a control means for said valve means;

wherein the valve means comprise a mechanically operated monostable valve and the control means are mechanical means and comprise a mechanical feeler configured to cooperate, in use, with the road surface or with a mobile member of said attachment assembly and to close the monostable valve when the height of the cutting edge from the road surface exceeds a predefined threshold value.

2. The blade according to claim 1, wherein the monostable valve comprises a mobile switching member and in that said mechanical feeler is fixed or hinged to said mobile switching member.

3. The blade according to claim 1, wherein the mechanical feeler is arranged adjacent to said snow removal cutting edge.

4. The blade according to claim 3, wherein the mechanical feeler is arranged downstream of said cutting edge in the forward direction of said blade.

5. The blade according to claim 1, wherein the motorized attachment and moving assembly comprises a mobile plate for the attachment to said rolling body and in that said mechanical feeler and the monostable valve are adjacent to said mobile plate.

6. The blade according to claim 1, wherein the motorized attachment and moving assembly comprises a fixed plate for the attachment to said feeding means and in that said mechanical feeler and the monostable valve are adjacent to said fixed plate.

7. A method for removing snow from a snow-covered road surface by using a snowplow blade as claimed in claim 1; the method comprising the steps of moving the blade forward along the road surface to be cleaned, arranging the blade in its lowered snow removing position by positioning the snow removal cutting edge at a predefined height from the road surface thus leaving a layer of residual snow on the road surface and feeding, towards the layer of residual snow, a de-icing material for the residual snow; the method being characterized by mechanically detecting in a continuous manner the height of the blade or the cutting edge from the road surface and interrupting the delivery of said de-icing material when the height of the cutting edge from the road surface exceeds a predefined threshold value.

8. The method according to claim 7, wherein the detection of the height is carried out by bringing a mechanical feeler into contact with the road surface.

9. The method according to claim 7, wherein the detection of the height is carried out by elastically thrusting a mechanical feeler against a mobile member of the motorized attachment and moving assembly of the rolling body.

10. The method according to claim 8, wherein the thrusting of the mechanical feeler into contact with the road surface or with said mobile member is exerted during lowering of the blade towards its snow removal position.

11. The method according to claim 8, wherein the interruption of the delivery of the de-icing material is achieved by acting with the mechanical feeler directly and mechanically on a mobile switching member of a mechanically operated monostable valve.

* * * * *